United States Patent [19]

Chia et al.

[11] 4,140,549

[45] Feb. 20, 1979

[54] METHOD OF FABRICATING AN ALUMINUM ALLOY ELECTRICAL CONDUCTOR

[75] Inventors: E. Henry Chia; Roger J. Schoerner, both of Carrollton, Ga.

[73] Assignee: Southwire Company, Carrollton, Ga.

[21] Appl. No.: 685,469

[22] Filed: May 12, 1976

Related U.S. Application Data

[63] Continuation-in-part of Ser. No. 505,821, Sep. 13, 1974, abandoned, which is a continuation of Ser. No. 194,757, Nov. 1, 1971, abandoned.

[51] Int. Cl.[2] ..... C22F 1/04

[52] U.S. Cl. ..... 148/2; 75/139; 148/11.5 A; 148/32

[58] Field of Search ..... 148/2, 3, 11.5 A, 32, 148/32.5; 75/139, 141, 142

[56] References Cited

U.S. PATENT DOCUMENTS

| | | | |
|---|---|---|---|
| 3,615,371 | 10/1971 | Nakajima et al. | 75/141 |
| 3,711,339 | 1/1973 | Besel et al. | 148/32.5 |

*Primary Examiner*—R. Dean

*Attorney, Agent, or Firm*—Herbert M. Hanegan; Stanley L. Tate; Robert S. Linne

[57] ABSTRACT

This invention relates to a method for continuously casting an aluminum-copper and an aluminum-copper-iron alloy having an acceptable electrical conductivity and improved elongation, bendability and tensile strength wherein the method generally comprises the steps of pouring molten aluminum alloy into the groove of a continuous casting mold, cooling the molten aluminum in the casting groove, hot forming the cast bar to form a rod and continuously coiling the rod at a temperature of from about 250° F to 700° F.

9 Claims, No Drawings

METHOD OF FABRICATING AN ALUMINUM ALLOY ELECTRICAL CONDUCTOR

This application is a continuation-in-part of copending application Ser. No. 505,821 filed Sept. 13, 1974, abandoned which in turn is a continuation of Ser. No. 194,757 filed Nov. 1, 1971 now abandoned.

BACKGROUND OF THE DISCLOSURE

This invention relates to a method of fabricating an aluminum alloy and more particularly this invention relates to a method of fabricating an aluminum alloy electrical conductor having an acceptable electrical conductivity and improved elongation, bendability and tensile strength.

The use of aluminum alloy electrical conductors is now well established in the art. Such alloys characteristically have conductivities of at least fifty-seven percent (57%) of the International Annealed Copper Standard, hereinafter referred to as IACS, and alloying constituents consisting of a substantial amount of pure aluminum and small amounts of conventional alloying elements such as silicon, vanadium, iron, copper, manganese, magnesium, zinc, boron and titanium. In the past not only have the physical properties of prior aluminum alloy conductors proven to be less than desirable for many applications but several of the prior art aluminum alloys have been difficult to process and particularly the aluminum-copper-iron alloys have been especially difficult to process into acceptable rod and wire. For example aluminum-copper-iron alloy wire processed by prior art methods have been found to have an ultimate tensile strength in excess of 50,000 psi, an electrical conductivity of only 56.6 percent.

Thus it becomes apparent that there is a need within the industry for an aluminum-copper-iron alloy electrical conductor and a method for producing the same whereby the conductor so produced has acceptable electrical conductivity, and improved elongation, bendability and tensile strength.

SUMMARY OF THE INVENTION

It is therefore an object of the present invention to provide a method of processing aluminum-copper and aluminum-copper-iron alloys which have an acceptable electrical conductivity, elongation and ultimate tensile strength.

It is another object of the present invention to provide a method for processing aluminum-copper and aluminum-copper-iron alloys having physical and electrical properties suitable for electrical conductors.

It is still another object of the present invention to provide a method of processing aluminum-copper and aluminum-copper-iron alloys which does not excessively work harden the alloy during hot rolling.

Yet another object of the present invention is to provide a method of processing aluminum-copper and aluminum-copper-iron alloys whereby rod produced is coiled at a temperature at which there is sufficient latent heat remaining in the rod to allow for metallurgical recovery of the crystaline structure of the alloy.

These and other objects, features and advantages of the present invention will become apparent to those skilled in the metallurgical art from a consideration of the following detailed description of the invention in terms of the preferred embodiment thereof.

DESCRIPTION OF THE PREFERRED EMBODIMENT

In a preferred embodiment of the present invention an aluminum alloy electrical conductor is fabricated from an aluminum alloy comprising from about 98.70 weight percent to about 99.90 weight percent aluminum and from about 0.10 weight percent to about 1.00 weight percent copper. Preferably, the aluminum content of alloy comprises from about 99.25 to about 99.85 weight percent, with superior results being achieved when from about 99.40 to about 99.80 weight percent aluminum is employed. Preferably the copper content of the present alloy comprises from about 0.15 to about 0.75 weight percent, with superior results being obtained when from about 0.20 weight percent to about 0.30 weight percent copper is used. It has been found that electrical conductors having aluminum alloy constituents which fall within the above specified ranges and which have been processed according to the method of the present invention possess acceptable electrical conductivity and improved tensile strength and ultimate elongation in addition to the novel and unexpected properties of increased bendability and fatigue resistance.

The aluminum alloy used in the practice of the method of the present invention also contains impurities present in trace quantities. Typical impurities present in the aluminum alloy are vanadium, iron, silicon, manganese, magnesium, zinc, boron and titanium. The impurities present in the aluminum alloy are present in concentrations of no more than about 0.10 weight percent each with the total concentration of impurities not exceeding about 0.30 weight percent. It must be understood, however, that when adjusting the concentrations of impurities present in aluminum alloy, consideration must be given to the conductivity of the final alloy since some impurities affect conductivity more severely than others.

The method of the present invention has also been successfully employed to produce acceptable electrical conductors from an aluminum alloy which consists essentially of from about 0.10 to about 1.00 weight percent copper, from about 0.30 to about 0.95 weight percent iron and from about 98.50 weight percent to about 99.60 weight percent aluminum. As was the case with the aluminum copper alloy described above not more than about 0.10 weight percent each of impurities selected from the group consisting of vanadium, silicon, manganese, magnesium, zinc, boron and titanium might also be present in the aluminum alloy. The total concentrations of all impurities must never exceed about 0.30 weight percent and the total concentration of copper and iron must not exceed about 1.20 weight percent. Acceptable results have been obtained when the electrical conductor is fabricated from an alloy having an iron concentration of less than about 0.50 weight percent and a copper concentration of more than about 0.50 weight percent. It has also been found that acceptable results are obtained when the iron concentration of the aluminum alloy is more than about 0.50 weight percent and the copper concentration is less than about 0.50 weight percent.

One example of a continuous casting and rolling operation capable of producing continuous rod as specified in this application is contained in the following paragraphs.

A continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove partially closed by an endless belt supported by the casting wheel and an idler pulley. The casting wheel and the endless belt cooperate to provide a mold into one end ofwhich molten metal is poured to solidify and from the other end of which the cast bar is emmitted in substantially that condition in which it solidified.

The rolling mill is of conventional type having a plurality of roll stands arranged to hotform the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hotforming temperature within the range of temperatures for hotforming the cast bar at the initiation of hotforming without heating between the casting machine and the rolling mill. In the event that it is desired to closely control the hotforming temperature of the cast bar within the conventional range of hotforming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling milll are rotated at a predetermined speed by a power means such as one or more electrical motors and the casting wheel is rotated at a speed generally determined by its operating characteristics. The rolling mill serves to hotform the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. This varying surface engagement of the cast bar in the roll stands functions to knead or shape the metal in the cast bar in such a manner that it is worked at each roll stand and also to simultaneously reduce and change the cross sectional area of the cast bar into that of the rod.

As each roll stand engages the cast bar, it is desirable that the cast bar be received with sufficient volume per unit for time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cross-sectional shape defined by the adjacent peripheries of the rolls of each roll stand.

Generally when an aluminum alloy is continuously cast the temperature of the cast bar is substantially reduced during the rolling operation. The rate of temperature reduction during rolling is usually so great that the hot working of the bar ceases approximately two-thirds of the way through the rolling mill. Thus as the temperature of the bar is reduced during the rolling operation the alloying elements precipitate from solution and because the precipitation occurs at reduced temperatures the precipitates formed are small and evenly distributed throughout the aluminum matrix. If aluminum-copper or aluminum-copper-iron intermetallic compounds are allowed to precipitate at reduced temperatures thereby becoming evenly distributed throughout the metal matrix the alloy becomes highly work-hardened during rolling. The method of the present invention reduces work hardening in that the alloy is hot-rolled at a temperature substantially higher than normal and coiled at a temperature of from about 250° F. to about 700° F. thereby bring about a coarsening of the intermetallic compound precipitates and reducing the work hardening effect of rolling. Rolling and coiling the alloy at these elevated temperatures cause the copper in solution to come out of solution during rolling thereby imparting to the alloy the improved properties previously discussed. Processing with intermediate anneals is acceptable when the requirements for physical properties of the wire permit reduced values. The conductivity of the hard drawn wire is at least 57 percent IACS. If greater conductivity or increased elongation is desired, the wire may be annealed or partially annealed after the desired wire size is obtained and cooled. Fully annealed wire has a conductivity of at least 58 percent IACS. At the conclusion of the annealing operation, it is found that the annealed alloy wire has the properties of acceptable conductivity and improved tensile strength together with unexpectedly improved percent ultimate elongation and surprisingly increased bendability and fatigue resistance as specified previously in this application. The annealing operation may be continuous as in resistance annealing, induction annealing, convection annealing by continuous furnaces or radiation annealing by continuous furnaces, or, preferably, may be batch annealed in a batch furnace. When continuously annealing, temperatures of about 450° F. to about 1200° F. may be employed with annealing times of about five minutes to about 1/10,000 of a minute. Generally, however, continuous annealing temperatures and times may be adjusted to meet the requirements of the particular overall processing operation so long as the desired tensile strength is achieved. In a batch annealing operation, a temperature of approximately 400° F. to about 750° F. is employed with residence times of about thirty (30) minutes to about twenty-four (24) hours. As mentioned with respect to continuous annealing, in batch annealing the times and temperatures may be varied to suit for the overally process so long as the desired tensile strength is obtained.

By way of example, it has been found that the following tensile strengths in the present aluminum wire are achieved with the listed batch annealing temperature and times.

TABLE I

| Tensile Strength | Temperature (° F.) | Time (hrs.) |
|---|---|---|
| 12,000-14,000 | 650 | 3 |
| 14,000-15,000 | 550 | 3 |
| 15,000-17,000 | 520 | 3 |
| 17,000-22,000 | 480 | 3 |

A typical alloy No. 12 AWG wire of the present invention has physical properties of 15,000 p.s.i. tensile strength, ultimate elongation of 20%, conductivity of 58% IACS, and bendability of 20 bends to break. Ranges of physical properties generally provided by No. 12 AWG wire prepared from the present alloy include tensile strengths of about 12,000 to 22,000 p.s.i., ultimate elongations of about 40% to about 5%, conductivities of about 57% to about 60% and number of bends to break of about 45 to 10.

A more complete understanding of the invention will be obtained from the following examples.

EXAMPLE NO. 1

Various melts were prepared by adding the required amount of copper to 1816 grams of molten aluminum, containing less than 0.30% trace element impurities, to achieve a percentage concentration of elements as shown in the accompanying table; the remainder being aluminum. Graphite crucibles were used except in those cases where the alloying elements were known carbide formers, in which case aluminum oxide crucibles were used. The melts were held for sufficient times and at sufficient temperatures to allow complete solubility of the alloying elements within the base aluminum. An argon atmosphere was provided over the melt to prevent oxidation. Each melt was continuously cast on a continuous casting machine and immediately hot-rolled through a rolling mill to ⅜ inch continuous rod. The rod was hot-rolled and coiled at the higher than normal temperatures previously mentioned in order to supress the rate of work hardening in subsequent operations. Wire was then drawn and annealed from the rod (soft [annealed] wire from hard [as rolled] rod). The final wire diameter obtained was 0.1019 inches, 10 gauge AWG.

The types of alloys employed and the results of the tests performed thereon are as follows:

TABLE II

| WEIGHT PERCENT CU | TOTAL TRACE ELEMENTS | UTS | % ELONG. | % IACS |
|---|---|---|---|---|
| .10 | 0.11 | 17,500 | 12.5 | 60.75 |
| 0.40 | 0.19 | 18,300 | 22.6 | 59.95 |
| 0.70 | 0.16 | 17,900 | 24.8 | 58.60 |
| 1.00 | 0.23 | 22,100 | 20.6 | 57.52 |

% Elong. = Percent ultimate elongation
UTS = Ultimate Tensile Strength
% IACS = Conductivity in Percentage IACS

EXAMPLE NO. 2

An additional alloy melt was prepared according to Example No. 1 so that the composition was as follows in weight percent:

Copper — 0.30
Iron — 0.09
Other Trace Elements — 0.08
Aluminum — Remainder

The melt was processed to a No. 10 gauge soft wire. The physical properties of the wire were as follows:

Ultimate Tensile Stength — 18,200 psi
Percent Ultimate Elongation — 25.2%
Conductivity — 60.10% IACS

EXAMPLE NO. 3

An additional alloy melt was prepared according to Example No. 1 so that the composition was as follows in weight percent:

Copper — 0.50%
Iron — 0.08
Other Trace Elements — 0.13
Aluminum — Remainder

The melt was processed to a No. 10 gauge soft wire. The physical properties of the wire were as follows:

Ultimate Tensile Strength — 17,400 psi
Percent Ultimate Elongation — 18.5%
Conductivity — 60.30% IACS

EXAMPLE NO. 4

An additional alloy melt was prepared according to Example No. 1 so that the composition was as follows in weight percent:

Copper — 0.85
Iron — 0.05
Other Trace Elements — 0.21
Aluminum — Remainder

The melt was processed to a No. 10 gauge soft wire. The physical properties of the wire were as follows:

Ultimate Tensile Strength — 21,200 psi
Percent Ultimate Elongation — 16.5%
Conductivity — 59.10% IACS Through testing and analysis of the alloys of this invention it has been found that the present aluminum alloys, after cold working, include the intermetallic compound precipitate $Al_2Cu$. This intermetallic compound has been found to be very stable and especially so at high temperatures. In addition it has a low tendency to coalesce during annealing of products formed from the alloy and the compound is generally incoherent with the aluminum matrix. The mechanism of strengthening for this alloy is in part due to the dispersion of the intermetallic compound as a precipitate throughout the aluminum matrix. The precipitate tends to pin dislocation sites which are created during cold working of the wire formed from the alloy. Upon examination of a cold drawn wire, it is found that the precipitates are oriented in the direction of drawing. In addition, it is found that the precipitates can be rod-like, plate-like, or spherical in configuration.

Intermetallic compounds which may be formed, depending upon the constituents of the melt and the relative concentrations of the alloying elements, include the following: $Al_7Cu_2Fe$, $Ni_2Al_3$, $Ni_2Al_3$, MgCoAl, $Fe_2Al_5$, $FeAl_3$, $Co_2Al_9$, $Co_4Al_{13}$, $CeAl_4$, $CeAl_2$, $VAl_{11}$, $VAl_7$, $VAl_6$, $VAl_3$, $VAL_{12}$, $Zr_3Al$, $Zr_2Al$,$LaAl_4$, $LaAl_2$, $Al_3Ni_2$, $Al_2Fe_5$, $Fe_3NiAl_{10}$, $Co_2Al_5$, $FeNiAl_9$.

A characteristic of high conductivity aluminum alloy wires which is not indicated by the historical tests for tensile strength, percent elongation and electrical conductivity is the possible change in properties as a result of increases, decreases or fluctuations of the temperature of the strands. It is apparent that the maximum operating temperature of a strand or series of strands will be affected by this temperature characteristic. The characteristic is also quite significant from a manufacturing viewpoint since many insulation processes require high temperature thermal cures.

It has been found that the aluminum alloy wire of the present invention has a characteristic of thermal stability which exceeds the thermal stability of conventional aluminum alloy wires.

For the purpose of clarity, the following terminology used in this application is explained as follows:

Aluminum alloy rod — A solid product that is long in relation to its cross-section. Rod normally has a cross-section of between three inches and 0.375 inches.

Aluminum alloy wire — A solid wrought product that is long in relation to its cross-section, which is square or rectangular with sharp or rounded corners or edges, or is round, a regular hexagon or a regular octagon, and whose diameter or greatest perpendicular distance between parallel faces is between 0.374 inches and 0.0031 inches.

While this invention has been described in detail with particular reference to preferred embodiments thereof, it will be understood that variations and modifications can be effected within the spirit and scope of the invention as described hereinbefore and as defined in the appended claims.

What is claimed:

1. A method of continuously casting an aluminum-copper-iron alloy to form an electrical conductor having a minimum conductivity of fifty-seven percent (57%) IACS comprising the steps of:

(a) pouring a molten aluminum base alloy, consisting essentially of from about 0.10 weight percent to about 1.00 weight percent copper, the remainder being aluminum with associated trace elements wherein the total concentration of trace elements is no greater than about 0.30 weight percent, into the casting groove of a continuous casting mold at a temperature above the melting point of the aluminum base alloy;

(b) cooling the molten aluminum base alloy in the casting groove to a temperature below the melting point of said alloy and removing a substantially solid cast bar from the casting groove;

(c) continuously hot forming the cast bar, at a temperature sufficient to cause substantial precipitation of aluminum-copper intermetallic compounds, to form a rod; and (d) continuously hot coiling the rod at a temperature of from about 250° F. to about 700° F., thereby coarsening the intermetallic precipitates.

2. The method of claim 1 wherein the aluminum alloy consists of 99.15 weight percent aluminum with associated trace elements and 0.85 weight percent copper.

3. The method of claim 1 wherein the aluminum alloy consists of from about 99.25 to about 99.85 weight percent aluminum with associated trace elements and from about 0.15 weight percent to about 0.75 weight percent copper.

4. The method of claim 1 wherein the aluminum alloy consists of from about 0.20 weight percent to about 0.30 weight percent copper with the balance being aluminum with associated trace elements.

5. The method of claim 1 wherein the aluminum alloy consists of from about 0.10 weight percent to about 1.00 weight percent copper, from about 0.30 weight percent to about 0.95 weight percent iron and from about 98.50 weight percent to about 99.60 weight percent aluminum, said aluminum containing no more than about 0.10 weight percent each of trace elements selected from the group consisting of vanadium, silicon, manganese, magnesium, zinc, boron and titanium with the total concentration of all trace elements never exceeding about 0.30 weight percent.

6. The method of claim 5 wherein the total copper and iron concentration of the aluminum alloy does not exceed about 1.20 weight percent and the rod contains aluminum-copper-iron compounds as intermetallic precipitates..

7. A method of continuously casting an aluminum alloy to form an electrical conductor having a minimum electrical conductivity of 57% IACS and having dispersed therein particles of an aluminum-copper intermetallic compound having, after cold working, a cross-sectional diameter of up to 1 micron, said aluminum alloy consisting essentially of from about 0.10 to about 1.00 weight percent copper and from about 98.70 to about 99.90 weight percent aluminum, said aluminum containing no more than about 0.10 weight percent each of trace elements selected from the group consisting of vanadium, silicon, manganese, magnesium, zinc, boron and titanium, with the total trace element concentration never exceeding about 0.30 weight percent, comprising the steps of:

(a) pouring the molten aluminum alloy into the casting groove of a continuous casting mold at a temperature above the melting point of the alloy;

(b) cooling the molten aluminum base alloy in the casting groove to form a substantially solid cast bar and removing a cast bar from the casting groove;

(c) continuously hot forming the cast bar to form a rod at a temperature sufficient to cause intermetallic compounds to precipitate; and (d) continuously hot coiling the rod at a temperature of from about 250° F. to about 700° F. thereby coarsening the intermetallic compound precipitates.

8. The method of claim 7 wherein the aluminum alloy consists of from about 99.25 to about 99.85 weight percent aluminum with associated trace elements and from about 0.15 to about 0.75 weight percent copper.

9. The method of claim 7 wherein the aluminum alloy consists of from about 0.20 to about 0.30 weight percent copper with the balance being aluminum with associated trace elements.

* * * * *